United States Patent [19]

Coudriet

[11] Patent Number: 4,867,646

[45] Date of Patent: Sep. 19, 1989

[54] LIQUID EVACUATION SYSTEM

[76] Inventor: Lawrence A. Coudriet, 202 Trail Side Dr., Sewickley, Pa. 15143

[21] Appl. No.: 183,600

[22] Filed: Apr. 19, 1988

[51] Int. Cl.[4] ..... F04B 49/00

[52] U.S. Cl. ..... 417/40; 417/43; 417/76

[58] Field of Search ..... 417/41, 76, 38, 191, 417/44, 12, 40, 182.5, 185, 187, 245, 85, 87, 88, 2, 426

[56] References Cited

U.S. PATENT DOCUMENTS

| | | | |
|---|---|---|---|
| 2,765,743 | 7/1985 | Sloan | 417/40 |
| 3,963,374 | 6/1976 | Miskin | 417/40 |
| 3,963,376 | 6/1976 | Sullivan | 417/40 |
| 3,975,115 | 12/1983 | Buchanan | 417/40 |
| 4,422,829 | 8/1976 | Fisher | 417/38 |
| 4,529,359 | 10/1956 | Hollinshead | 417/44 |

*Primary Examiner*—Carlton R. Croyle
*Assistant Examiner*—Robert N. Blackmon
*Attorney, Agent, or Firm*—Richard M. Bies

[57] ABSTRACT

Liquid is removed from a remote location, with control of the system responsive to the supply of the liquid to be removed. Control is accomplished without the need for electrical devices at the remote location by means of a valve in the remote location in the conduit circulating a powering fluid to a pump at the remote location, and the sensing of the accompanying changes in flow or pressure in the powering fluid conduit or output conduit.

13 Claims, 4 Drawing Sheets

LIQUID EVACUATION SYSTEM

BACKGROUND OF THE INVENTION

Field of the Invention: This invention relates to an apparatus and method for evacuating liquid from a remote location without the use of electrical controls at the remote location, by means of a fluid powered pump, which may be simply a jet pump, at the remote location together with a valve in the conduit supplying fluid power to the remote pump, which valve responds to the supply of liquid to be removed, and a sensor outside the remote location which responds to the change in flow or pressure caused by the operation of the valve.

Description of the prior art: The inventor is aware of the use of a remote fluid powered pump to evacuate fluid from a remote location without any means within the system to respond to the depletion of the liquid to be removed. A search has disclosed various modifications of the jet pump, but none employing a similar system for purposes of control.

In situations in which the atmosphere may be explosive, or where the supplying of electrical power and components may be expensive or inconvenient, the avoidance of the same in the location of the liquid to be removed becomes important. A typical example is mine de-watering, where the atmosphere in a water laden area of the mine may be explosive, and where it would be necessary for a person to frequently inspect the electrical equipment while it is operating.

DESCRIPTION OF THE PREFERRED EMBODIMENTS

Figure 1:
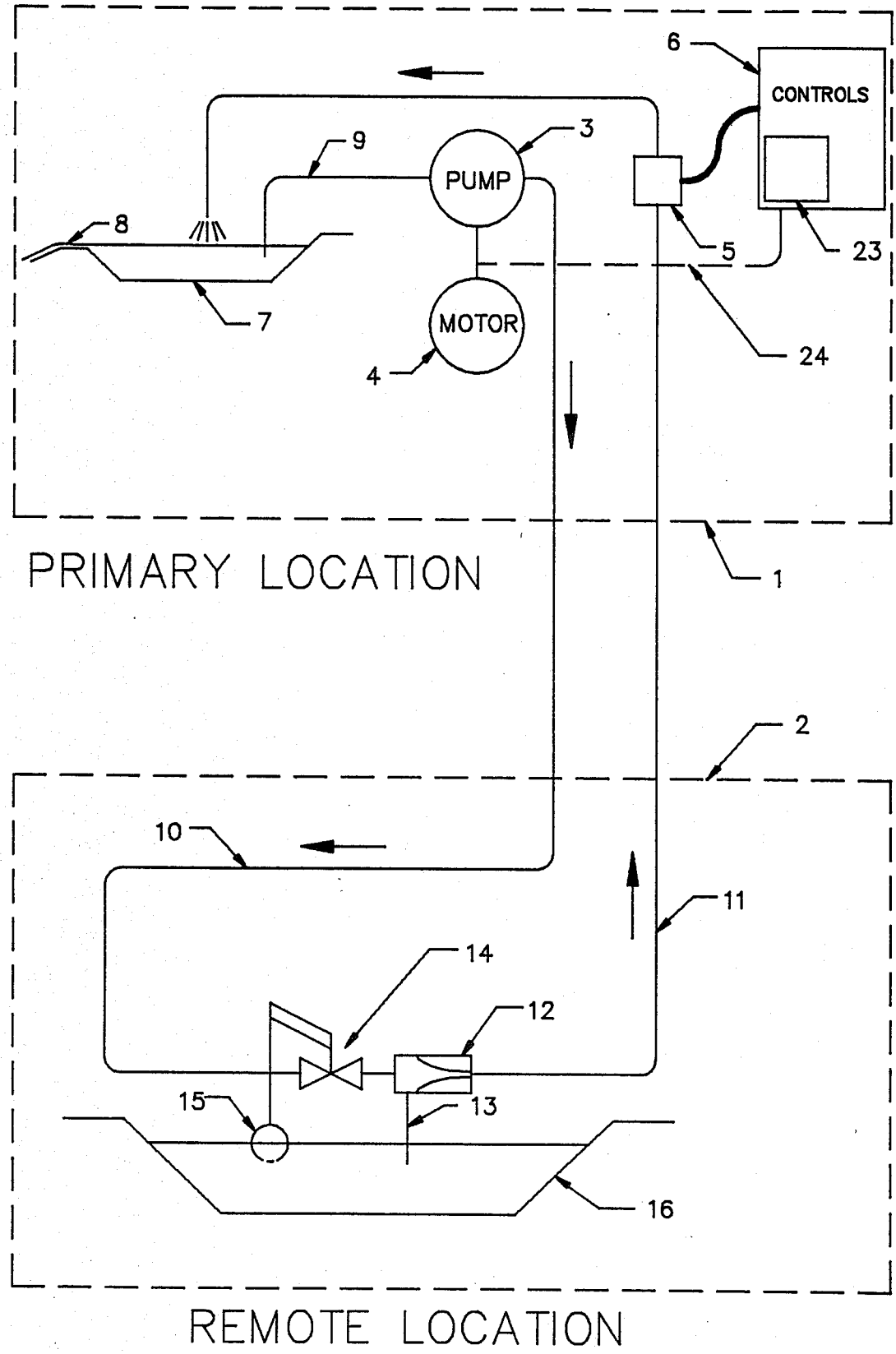
FIG. 1 is a schematic illustration of the preferred embodiment of the invention using a jet pump type fluid powered pump at the remote location.

With reference to FIG. 1 it will be seen that a Liquid Evacuation System according to the present invention includes a fluid powered pump 12, specifically a jet pump, in remote location 2 to remove liquid inventory 16. Valve 14 in inlet conduit 10 to pump 12 is operated by inventory sensing device 15, shown as a float, but other methods of measuring the inventory of liquid to be removed may be used, the valve 14 being closed when the liquid inventory 16 is reduced to the desired amount, thereby interrupting the operation of pump 12. Liquid from liquid inventory 16 is drawn into pump 12 by means of intake conduit 13, and pump 12 discharges from the remote location through discharge conduit 11.

At the primary location 1, where access to electrical power is convenient, primary pump 3 drives a powering fluid to the remote site through conduit 10. Pump 3 is driven by by a motive means such as motor 4, typically an electric motor, but other motive means may be used. Pump 3 is shown as intaking, through conduit 9, fluid from reservoir 7, which receives the discharge from conduit 11, although the intake of fluid could be otherwise provided. In this preferred embodiment, the powering fluid pumped from pump 3 to pump 12 is the same liquid as being evacuated from the liquid inventory 16.

When valve 14 in the remote location closes, this condition can be sensed outside remote location 2 as a drop in flow or change in pressure in the conduits in the primary location, or in the discharge conduit. In the preferred embodiment of FIG. 1, the flow or pressure sensing means 5 is shown in discharge conduit 11 within primary location 1. The change in flow or pressure is communicated from sensing means 5 to control means 6. Control means 6 then operates 24 to interrupt the powering of pump 3 by motor 4. When motor 4 is an electric motor, this interruption of pump 3 can be most expeditiously accomplished by removing electric power from motor 4, although other means, such as a clutch, may be employed. Where liquid inventory 16 is anticipated to be replenished, as by seepage in a mine, then control means 6 should incorporate a timing means 23 to re-start the apparatus periodically by restoring power to pump 3, so that if liquid inventory 16 is in fact replenished, then valve 14 will be open, or will open, and the apparatus will re-commence operation until the liquid inventory 16 is again reduced to the desired amount.

It can therefore be seen that this invention allows the evacuation of liquid from a remote site 2, where it may be inconvenient or expensive to supply electric power or frequent monitoring, without the need for the same at the remote site, as valve 14 can operate automatically but without electric power, and its condition can be sensed outside the remote location where it is practical to supply electric power or monitoring of the system.

Figure 4:
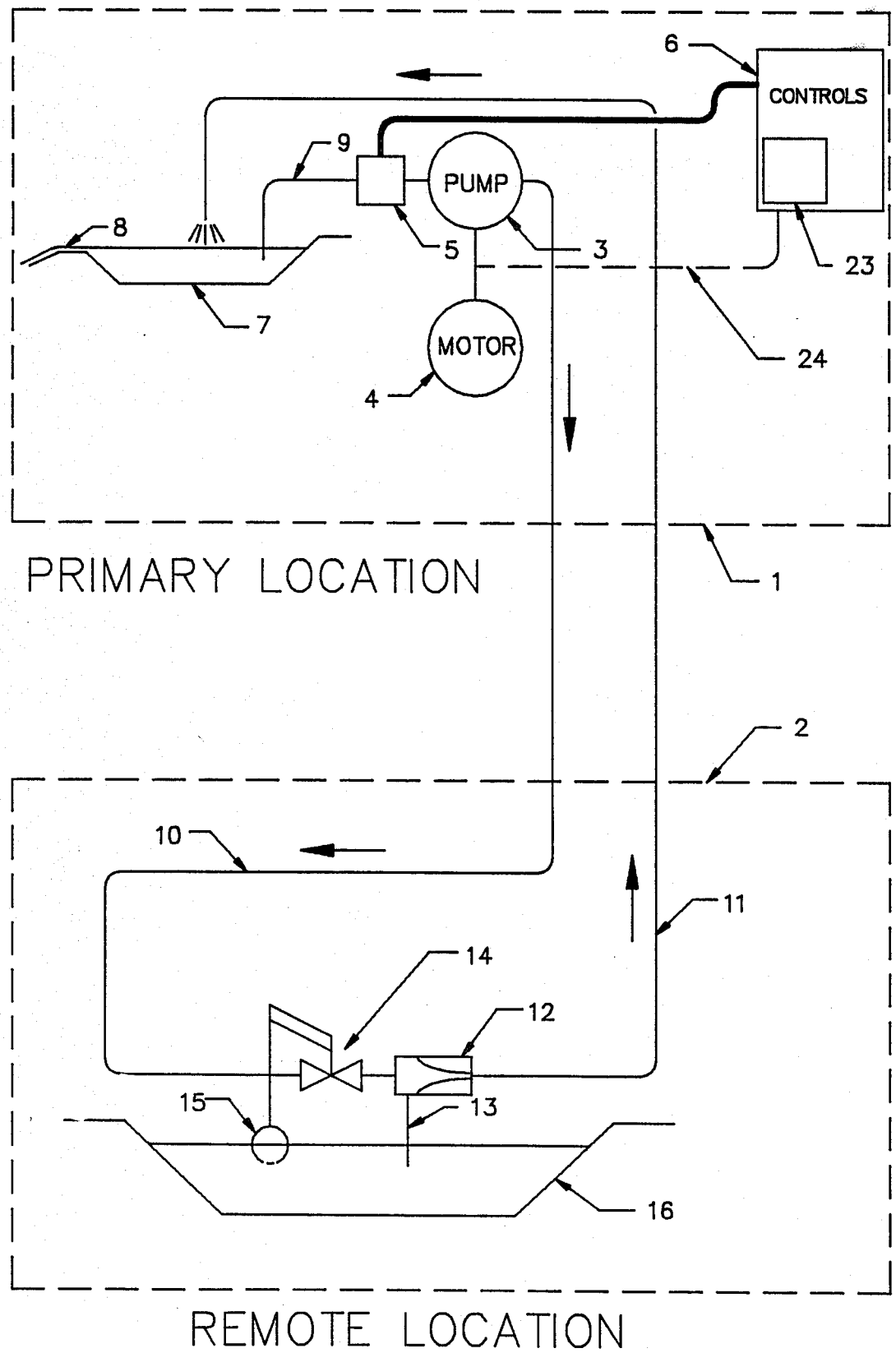
FIG. 4 is a schematic illustration of the preferred embodiment of the invention using a jet pump type fluid powered pump at the remote location, and an alternate location of the sensing means.

FIG. 4 shows the same embodiment as FIG. 1, but with the pressure sensing means 5 located in the intake conduit 9 to the powering pump 3.

Figure 2:
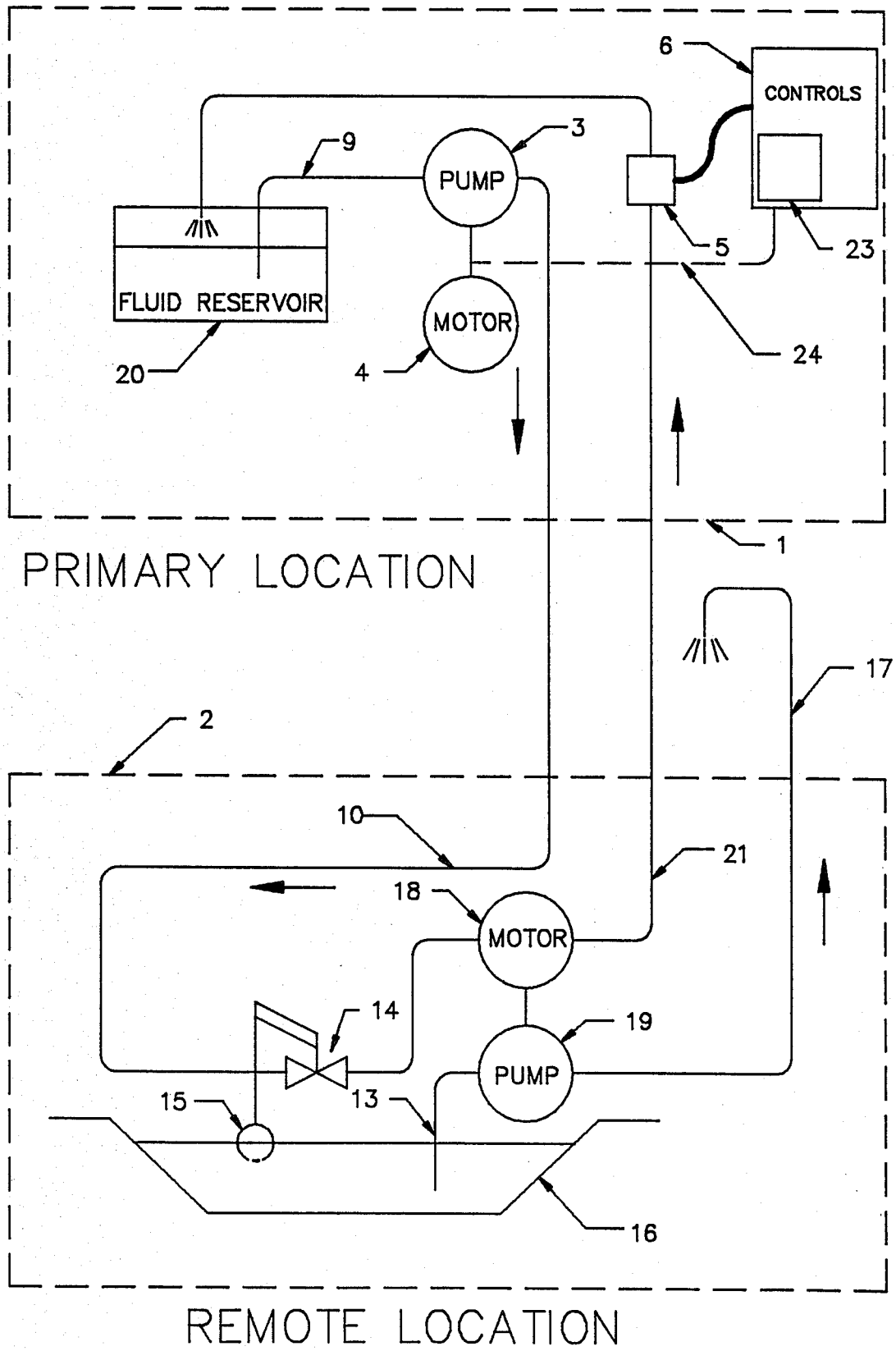
FIG. 2 is a schematic illustration of an embodment of the invention using a fluid powered pump with a return conduit for the powering fluid.

FIG. 2 shows an alternative embodiment wherein pump 19 in remote location 2 is driven by motor 18 by means of a powering fluid circulating from the primary location 1 through conduit 10 and returning through conduit 21 to fluid reservoir 20. In this embodment, the powering fluid is kept separate from the liquid inventory 16, which is discharged through conduit 17. This embodiment may be useful where the liquid to be evacuated is undesirable as a powering fluid, or where it is desirable to employ a different powering fluid, such as hydraulic fluid, to power the remote pump 19.

Figure 3:
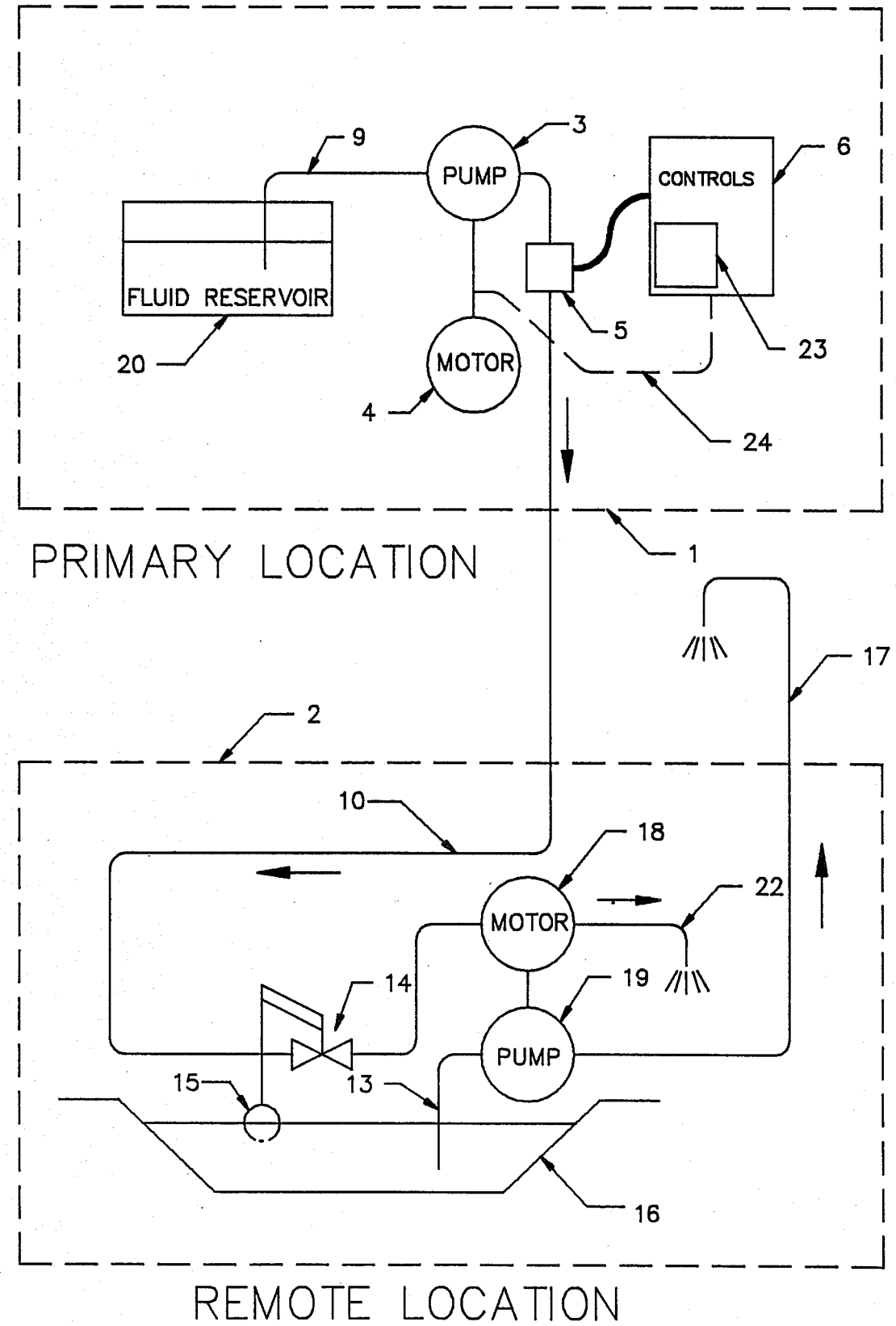
FIG. 3 is a schematic illustration of an embodiment of the invention using a fluid powered pump and an expendable fluid for the powering fluid.

FIG. 3 shows another embodiment wherein the powering fluid is expendable, such as steam or air. Here the powering fluid is vented through exhaust conduit 22, which is shown venting in the remote site 2, but may also vent outside remote site 2, and the sensing means 5 is shown in conduit 10.

In all embodiments, sensing means may be deployed in either the intake conduit 9 to the powering pump, the inlet conduit 10 delivering powering fluid to the remote site, or in conduit 21 returning powering fluid to the pump in the primary location 1, or in conduit 11 as in FIG. 1, which would carry both the discharged liquid to be evacuated and the returned powering fluid, or in discharge conduit 17. In all cases, the operation of valve 14 will cause a change in flow or pressure which can be sensed by sensing means 5 outside the remote location.

An additional alternative (FIG. 2) would be to locate valve 14 in return conduit 21, or in discharge conduit 17, the latter embodiment also necessitating the location of sensing means 5 in discharge conduit 17.

It will be apparent that the present invention provides means for expeditiously pumping a liquid from a remote location without electrical equipment at the remote location.

While the method herein described, and the form of apparatus for carrying this method into effect, constitute preferred embodiments of the invention, it is to be understood that the invention is not limited to this precise method and form of apparatus, and that changes may be made in either without departing from the scope of the invention which is defined in the appended claims.

I claim:

1. Apparatus for pumping liquid from a remote location, which comprises:

(a) a fluid powered pumping means at said remote location, including an intake conduit for receiving liquid from said remote location and a discharge conduit for delivering liquid away from said remote location;

(b) primary fluid pumping means and motive means for driving said primary pumping means located in a primary location distinct from said remote location;

(c) conduit means from said primary pumping means for delivering powering fluid to said fluid powered pumping means to drive said fluid powered pumping means in said remote location;

(d) valve means responsive to liquid inventory at the remote location, for regulating flow of said fluid to said fluid powered pump means at said remote location;

(e) flow or pressure sensing means away from the remote location for sensing the change in pressure or flow resulting from operation of said valve means;

(f) control means at the primary location for deactivating said motive means of the primary pump means in response to the operation of said flow or pressure sensing means.

2. The apparatus of claim 1 in which said powering fluid is contained in a closed loop of conduit from said primary pumping means to said fluid powered pump means and back to said primary pumping means.

3. The apparatus of claim 1 in which the fluid powered pump means is a jet type pump.

4. The apparatus of claim 2 in which the valve means is placed at the inlet side of said fluid powered pump means.

5. The apparatus of claim 2 in which the valve means is placed at the outlet side of said fluid powered pump means.

6. The apparatus of claim 1 in which the sensing means is placed at the inlet side of said powering pump means.

7. The apparatus of claim 1 in wihch the sensing means is placed at the outlet side of said powering pump means.

8. The apparatus of claim 1 in which the sensing means is placed in the discharge conduit from said fluid powered pump means.

9. The apparatus of claim 1 in which the said control means includes timing means to re-start said primary pump periodically.

10. A method of removing liquid from a remote location, which comprises:

(a) powering a pump at a primary location;

(b) pumping a powering fluid to a fluid powered pump at a remote location;

(c) sensing the inventory of the liquid to be removed from the remote location;

(d) regulating the flow of powering fluid to said fluid powered pump by valve means at said remote location in response to the liquid inventory;

(e) intaking the liquid to be removed into said fluid powered pump at the remote location, (f) deactivating the primary pump when the said liquid inventory is reduced to the desired level;

(g) discharging the liquid at a desired discharge location outside said remote location via a discharge conduit.

(h) communicating change in status of said valve means at said remote location to a point away from said remote location through internal changes in pressure or flow in the system caused by operation of said valve means.

11. The method of claim 10 including the additional step of sensing the flow or pressure in said powering fluid away from said remote location and carrying out the said deactivating in response to the change in the flow or pressure sensed.

12. The method of claim 10 including the additional step of sensing the flow or pressure in said discharge conduit and carrying out the said deactivating in response to the change in flow or pressure sensed.

13. The method of claim 10 including the additional step of re-starting said primary pump periodically.

* * * * *